United States Patent [19]

Vida et al.

[11] Patent Number: 4,959,588

[45] Date of Patent: Sep. 25, 1990

[54] DISCHARGE LAMP HAVING A DISCHARGE VESSEL MADE WITH A CERAMIC CLOSING MEMBER WITH AN INDENTED INNER SURFACE

[75] Inventors: Dénes Vida; Péter Ferenci, both of Budapest, Hungary

[73] Assignee: Tungsram RT, Budapest, Hungary

[21] Appl. No.: 327,892

[22] Filed: Mar. 23, 1989

[30] Foreign Application Priority Data

Mar. 28, 1988 [HU] Hungary ..... 1533/88

[51] Int. Cl.[5] ..... H01J 61/36

[52] U.S. Cl. ..... 313/625; 313/623; 313/566; 313/356

[58] Field of Search ..... 313/623, 624, 625, 613, 313/566, 634, 626, 356, 334

[56] References Cited

U.S. PATENT DOCUMENTS 3,892,993 7/1975 Timmermans ..... 313/623 X

*Primary Examiner*—Kenneth Wieder

*Attorney, Agent, or Firm*—Michael N. Meller

[57] ABSTRACT

In a high-pressure gas discharge lamp, particularly a high-pressure sodium vapor lamp, comprising a tubular discharge vessel being made of a ceramic material and including electrodes and a filling and ceramic plug elements for closing the end regions of the discharge vessel, receiving a current lead-in connecting the electrode with an outer source of supply voltage, wherein at least one of the plug elements is built up with surface elements of different height levels and determining a cold chamber for receiving the metal additive, the distance between the surface of the metal additive and the current lead-in measured as length of the way determined on the surface elements is at least 4 mm.

7 Claims, 3 Drawing Sheets

DISCHARGE LAMP HAVING A DISCHARGE VESSEL MADE WITH A CERAMIC CLOSING MEMBER WITH AN INDENTED INNER SURFACE

FIELD OF THE INVENTION

The present invention refers to a high-pressure gas discharge lamp, particularly a high-pressure sodium vapor lamp, comprising a tubular discharge vessel determining a discharge space, the discharge vessel being made of a ceramic material and including electrodes and a filling consisting of at least one ionizable rare gas and a metal additive, ceramic plug elements for closing the end regions of the discharge vessel, receiving a current lead-in connecting the electrode with an outer source of supply voltage and forming front surfaces of the discharge space, wherein at least one of the front surfaces is realized by surface elements of different height levels determining a cold chamber for receiving the metal additive. The metal additive may contain a sodium amalgam, the ceramic plug and the discharge vessel may be produced as an integrity.

BACKGROUND OF THE INVENTION

The gas discharge light sources constructed with symmetric or asymmetric arrangement of the gas discharge vessel, i.e. the gas discharge lamps have been known since longer time. Whatever kind of arrangement is applied, the general problem of these light sources is experienced, i.e. the asymmetric length of the current transient after the ignition has been finished. This means the asymmetry of the transition process from the glow discharge state to the normal discharge state. This problem follows mainly from the influence of the metal additive precipitating from the discharge space and being in galvanic contact with the electrodes and thereby with the electric current lead-ins forming an electric integrity with the electrodes. (The metal additive generally consists of sodium amalgam in the case of the high-pressure sodium vapor gas discharge light sources.) The metal additive is in most discharge lamps present at one of the electrodes, increasing its surface area and causing thereby prolongation of the glow discharge period, i.e. the ignition phase. The electrode free of conductive metal additive or contacting only a small amount thereof is capable of transiting to the normal discharge phase in shorter time then the other electrode contacting a greater amount of the metal additive, generally increasing the surface of the related electrode. As a consequence, during the ignition process the load of the electrode contacting the metal additive, e.g. the sodium amalgam is asymmetric with respect to the load of the other electrode.

There are known gas discharge lamps comprising a starting or ignition electrode adjacent to the main electrode. In this arrangements the metal additive precipitating from the gas discharge space in the region between the two electrodes can prevent the desired influence of the starting electrode. The ignition process can be facilitated only when the main electrode and the starting electrode are electrically isolated one from another.

After longer or shorter time of operation of the gas discharge light source, i.e. the gas discharge lamp the surfaces of the sealing material and the closing ceramic element may become electrically conductive. Therefore it is possible that the basic point of the electric discharge arc in the discharge lamp is created not on the peak of the electrode but on the conductive surface either of the sealing material, e.g. sealing varnish or of the closing ceramic element, e.g. the ceramic plug. A process of this kind results in very quick deterioration of the ceramic discharge vessel.

There are known gas discharge light sources comprising special dividing means for preventing the contact between the electrodes and the conductive metal additive, e.g. the sodium amalgam.

The application of such auxiliary means causes further problems. One of them lies in the sophisticated construction of the light source and the production technology difficulties arising thereby, or, if the construction can be simplified, in the sophisticated thermal conditions of the light source: either a heat reflecting element, e.g. a ring made of niobium or tantalum should be applied for ensuring the required increased temperature of the metal additive, e.g. sodium amalgam because of the too big distance between the electrode and the metal additive, or it is practically impossible to ensure the required process of precipitating the conductive metal additive in a predetermined region of the gas discharge light source, i.e. to fulfill the requirement that in the light source be a stable cold point, the so called cold chamber.

From the GB-A 1 465 212 a high pressure sodium vapor gas discharge lamp has become known, wherein the element closing the discharge vessel is provided with a ring shaped slot for receiving the sodium amalgam. The specification doesn't disclose the dimensions of this slot and because of applying a further recess around a niobium pipe serving as a current lead-in it can not be fully ensured that the slot is the coldest place in the gas discharge light source. This is a consequence of the fact that the temperature of the recess is also relatively low, because of the heat conducting process caused by the thermally conductive current lead-in. The proposed slot is therefore not sufficient for reliable prevention of the electric contact between the sodium containing amalgam and the electrode which forms an electric integrity with the current lead-in.

The Hungarian patent specification HU-B 181 872 shows a ceramic plug element for closing the gas discharge vessel, wherein a sack like recess is made in the central part of the plug. The object of this solution is to realize the cold chamber in the plug element (and not between the plug element and the wall of the discharge vessel) and to shield thereby the metal additive from the discharge space as effectively as possible.

The German patent document DE-Al 2 405 335 discloses a high-pressure gas discharge lamp, wherein the metal additive consisting of a sodium amalgam containing substance, which is electrically conductive, is shielded from the electrode by means of a special ceramic closing element, in order to prevent flickering during operation. This solution results in very sophisticated light source construction. The patent document EP 74 188 discloses that there is really no need of shielding the electrode fully from the conductive metal additive. This EP patent document includes the proposal of completing the niobium pipe supporting the electrodes with a shoulder made of ceramic material. The height level of arranging the shoulder follows from the fact that it may not shield the sodium containing amalgam from the electrode and its smallest width is determined on the basis of the requirement that heat capacity should be enough high to prevent the process of precipitation of the amalgam on its surface. The width is exemplified to be in the range from 0.2 to 0.5 mm, and the height equal to 1.5 mm. The disadvantage of this solution is that the operation of the gas discharge lamp depends on the height of the shoulder: if the shoulder is applied higher then a heat reflecting element should be applied for ensuring the required temperature of the amalgam, and if it is lower, then after longer operation of the lamp it can not prevent the conduction between the amalgam and the electrode or the element supporting the last.

Similarly, some disadvantages are characteristic also for the solution disclosed in the European patent specification EP 188 129. The element closing the discharge tube is constructed in such way that a ring shaped channel is created between the closing element and the wall of the discharge vessel. The maximal depth of the channel is allowed to be as big as the inner diameter of the discharge vessel. In this construction the main disadvantage follows from the fact that the ceramic material of the closing element can become conductive during the operation of the gas discharge lamp and this may result in a short circuiting process between the electrode and the amalgam, especially when preparing the channel with depth as proposed by the specification.

SUMMARY OF THE INVENTION

The object of the present invention is to create a construction of the gas discharge light sources, which ensures that the electrode can not be in electric contact with the conductive metal additive not only during shorter periods of operation but adter longer time of application, too. The improvement refers mainly to the low power high temperature gas discharge lamps, especially to the sodium vapor gas discharge lamps of improved color rendition qualities.

The invention is based on the recognition that the improvement of the construction of a high-pressure gas discharge lamp, especially a high-pressure sodium vapor gas discharge with respect to the problems listed above means that the required optimal temperature of the gas discharge vessel should be ensured and the surface conductive process between the electrode and the parts containing the metal additive, particularly the sodium amalgam has to be avoided in a way that the last process can not come into being also after longer operation of the gas discharge lamp. The increasing danger of the mentioned conducting process follows from the fact that during the operation of the gas discharge lamp the metallic component of the metal additive is slowly disappearing, and especially the sodium is capable of leaving the discharge vessel.

This recognition resulted in the consequence that the high-pressure gas discharge light sources should be realized with elements closing the discharge space and having surface elements of different height levels facing the discharge space. The difference of the height levels should follow from the fact that the distance between the surface of the conductive metal additive and the electrode or the current lead-in connected with the electrode measured on the surface elements should be as big as necessary for ensuring isolation during the operation of the gas discharge lamp. This means, the length of the conducting way should as big as sufficient for preventing the direct electric contact between the metal additive and the electrode during the whole life period of the gas discharge lamp.

The role of the length of the conducting way hasn't apparently been perceived in the known lamp constructions described in the background art. The solutions determining some dimensions described the depth of a slot, the width of a recess or the width of a shoulder. The general arrangement has been selected so that the length of the conducting way measured on the that surface of the ceramic plug element of the discharge vessel which faces the discharge space doesn't exceed 4 mm. The general conviction has been that a greater distance between the peak of the electrode and the surface of the metal additive can be dangerous for the operation. Such a distance was determined in the U.K. patent document GB-A 502 321 as an important parameter and the requirement was that it should have been in the range of about 2 mm.

The experiments carried out during elaborating the present invention showed that the front surface of the closing element should be shaped taking into account the length of the conducting way which has to be greater than a lower limit being substantially 4 mm.

By shaping the closing plug element of the discharge vessel in order to ensure the length of the conducting way as required by the invention it is possible to avoid the precipitation process of the metal additive from the gas discharge space to the neighborhood of the current lead-in and no direct electric contact exists between the metal additive and the electrode or the current lead-in integrated with the electrode. This construction means that except very specific situations no special heat reflecting means is necessary for ensuring and maintaining the required concentration of the additive components withind the discharge space.

On the basis of the recognition analysed above a high-pressure gas discharge lamp, particularly a high-pressure sodium vapor lamp of improved parameters has been developed which comprises a tubular discharge vessel determining a discharge space, the discharge vessel being made of a ceramic material and including electrodes and a filling consisting of at least one ionizable rare gas and a metal additive, particularly a sodium containing amalgam, ceramic plug elements for closing the end regions of the discharge vessel, expediently forming an integral unit with the discharge vessel, the ceramic plug element for receiving a current lead-in connecting the electrode with an outer source of supply voltage and froming front surface of the discharge space, wherein at least one of the front surfaces is built up with surface elements of different height levels determining a cold chamber for receiving the metal additive. The improvement of the proposed high-pressure gas discharge lamp lies in that the distance between the surface of the metal additive and the current lead-in measured as length of the way determined on the front surface of the plug element is at least 4 mm.

In an advantageous embodiment of the high-pressure gas discharge lamp according to the invention the front surface is determined by an inner trench made adjacent to the axis of the tubular discharge vessel and an outer trench divided a protuberant rib, wherein the distance is measured along a continuous line on the surface of the protuberant rib and on the basic surface of the inner trench. The cold chamber of the gas discharge lamp is determined by the protuberant rib.

The height level of the basic surface of the inner trench is generally higher than that of the outer trench, i.e. the outer trench lies deeper than the inner trench in the direction of the longitudinal axis of the discharge vessel.

In a further advantageous embodiment the width of the cold chamber is at most 2 mm, wherein the cold chamber is connected with or lies adjacent to the wall of the tubular discharge vessel.

For realizing a low power gas discharge light source is also advantageous when the distance between the end of the electrode protruding from the plug element and the surface of the metal additive, especially sodium containing amalgam arranged in the same plug element is at most three times greater than the distance between the electrode and the wall of the tubular discharge vessel, in most cases at most 5 mm.

The advantage of the high-pressure gas discharge light source proposed by the present invention lies in improving the operational conditions of the lamps of this kind and in prolongation their life time.

BRIEF DESCRIPTION OF THE DRAWINGS

The invention will be described in more detail by way of example and with reference to preferred embodiments illustrated in the drawings showing the particulars of the proposed high-pressure gas discharge lamp not always in correct proportions, in order to improve the illustrativeness. In the drawings

Figure 1:
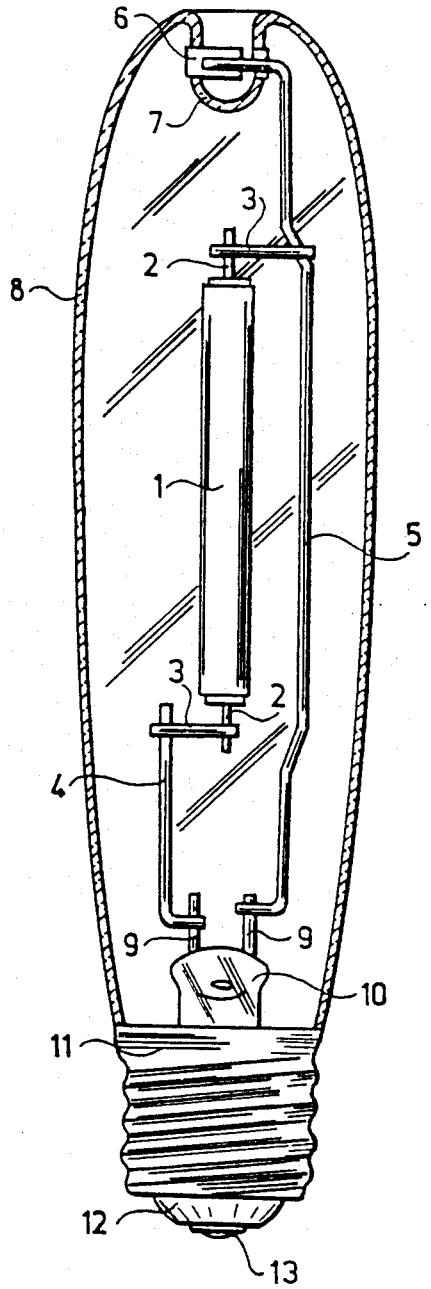
FIG. 1 is the schematic view of a high-pressure sodium lamp.

The proposed high-pressure gas discharge lamp is generally realized in form of a high-pressure sodium vapor lamp shown in FIG. 1. This sodium vapor lamp comprises in an outer envelope 8 made of translucent material a ceramic lighting body 1, i.e. a tubular discharge vessel which is connected with current lead-ins 2 made of niobium. The position of the ceramic lighting body 1 within the outer envelope 8 is ensured by supporting rods 4, 5 and fixing wires 3 connecting the supporting rods 4, 5 and the current lead-ins 2. The outer envelope 8 is made with an internal dome part 7 for receiving a resilient support 6 of the ceramic lighting body 1. The supporting rods 4 and 5 are connected with a stem 10 in the bottom part of the outer envelope 8 and thereby to a metallic socket 11, e.g. with normal screw, and to an electric contact element 13 divided from the socket 11 by an insulator 12. The arrangement of the elements shown in FIG. 1 is known per se and is common to the well-known gas discharge lamps.

The essence of the invention lies in closing the ceramic lighting body 1 by a specific plug element 15 shown in different embodiments in FIGS. 2 to 6.

Figure 2:
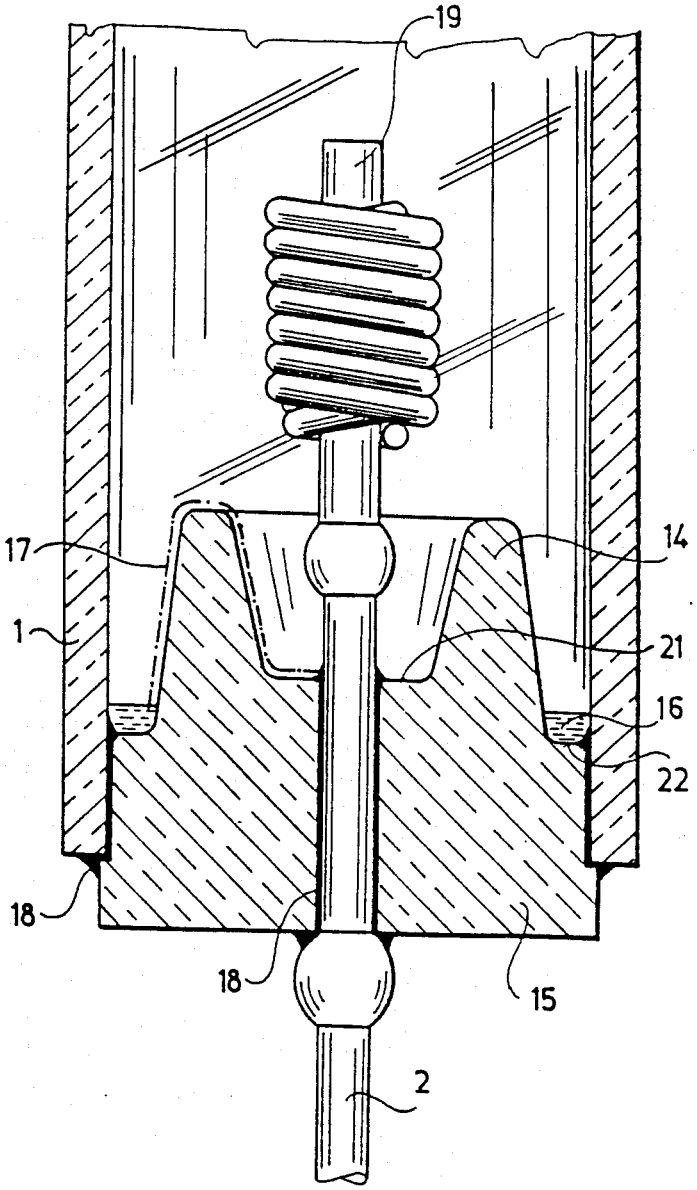
FIG. 2 shows the cross-section of a ceramic plug element limiting the discharge space.

In FIG. 2 the end part of a ceramic lighting body 1 is shown. This tubular body is closed by a plug element 15 having a protuberant rib 14 facing the inner space of the lighting body 1. This protuberant rib 14 determines an inner space surrounding the current lead-in 2 and an outer space for receiving a metal additive 16, especially a sodium containing amalgam. The inner space is formed in a preferred embodiment by an inner trench 21, the outer space by an outer trench 22. The current lead-in 2 is connected with an electrode 19. The matching surfaces are sealed with a sealing material 18 according to the well-known principles of the vacuum engineering.

A dotted line 17 determines the distance between the electrode 19 or the current lead-in 2 and the surface of the metal additive 16. According to the invention the length of the conducting way described by the dotted line 17 is at least 4 mm.

The protuberant rib 14 is generally a cylindric ring with parallel or substantially parallel surfaces as it is shown in the FIGS. 3 to 6, and, of course, the cross-section according to FIG. 2 can be also advantageous, if desired. The cross-section of the protuberant rib 14 is important for determining the shape of the cold chamber and the experience shows, it can be expediently selected in order to ensure a cold chamber with width not exceeding a minimal value of 2 mm.

The cold chamber lies generally at the ceramic wall of the lighting body 1 and advantageously is determined by the protuberant rib 14 and the ceramic wall.

According to the practical measurements the high pressure sodium vapor lamps and especially those characterized by low power can be built up with a compact construction wherein the distance between the peak of the electrode 19 and the surface of the metal additive 16 present in the cold chamber is selected to be not more than three times the distance between the electrode 19 and the ceramic wall of the lighting body 16. This distance should be measured between the peak of the electrode 19 protuberating from a plug element 15 and the surface of the metal additive 16 arranged in the same plug element 15, in the cold chamber; the measured distance may be selected to be less than 5 mm in the case of the lamps with lower power range.

As mentioned the main feature of the invention lies in preparing a ceramic plug element 15 for closing the ceramic lighting body 1, the ceramic plug element having a surface articulated in a manner that the length of the conducting way measured on this articulated surface from the top level of the metal additive 16 present in the cold chamber to the nearest point of the current lead-in 2 or the electrode 19 is at least 4 mm.

Figure 3:
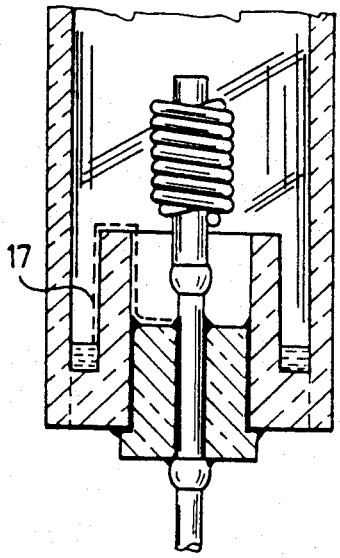
FIG. 3 is the schematic cross-section of a high-pressure ceramic discharge vessel with partly integrated closing arrangement.

According to FIG. 3 the plug element of the tubular lighting body 1 can be made together with the tubular wall by sintering a common ceramic body. The solution of FIG. 3 offers the advantage that the metal additive has no contact with the sealing material.

Figure 4:
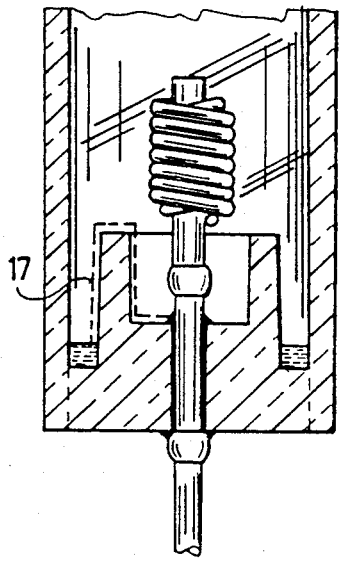
FIG. 4 is the schematic cross-section of a high-pressure ceramic discharge vessel with fully integrated closing arrangement.

FIG. 4 shows a tubular lighting body 1 made completely from a sintered ceramic body, wherein the electrode is only arranged in a hole, from the inner space of the tubular body by inserting it from the inside.

Figure 5:
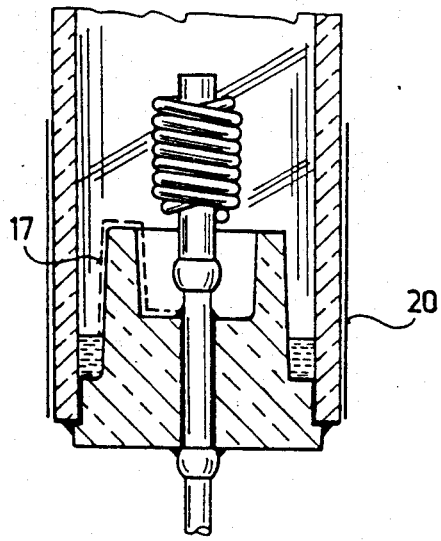
FIG. 5 is the schematic cross-section of a ceramic plug element built up according to the FIG. 2 with a shield element.

FIG. 5 shows an arrangement wherein a higher amount of the metal additive, especially a sodium containing amalgam can be applied. An outer termic screen 20 can surround the lower part of the tubular wall, in order to ensure the required temperature of the metal additive. The termic screen 20 is made e.g. of niobium.

Figure 6:
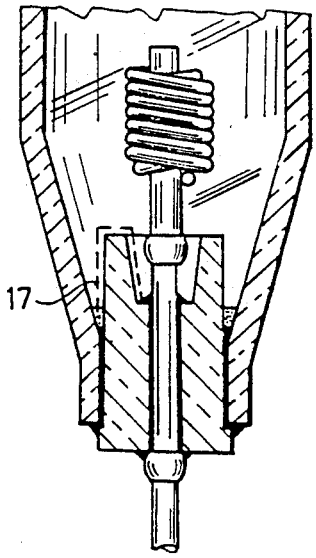
FIG. 6 is the schematic cross-section of a high-pressure discharge vessel with conic end region, in closed arrangement.

The tubular lighting body 1 is not always made with parallel walls. A tightening end region is shown in FIG. 6. The dotted line 17 representing the length of the conducting way is shown in FIGS. 3 to 6, too.

The embodiments shown in the FIGS. 2 to 6 illustrate different possibilities of realising the invention, without any limitation of the scope of the protection expressed in the terms of the attached claims.

The following examples helps to understand better the important features of the invention, however, they are not intended to limit the claimed scope of protection.

1. High-pressure sodium vapor lamp of 70 W power

The inner diameter of the ceramic discharge vessel is 3.3 mm, the length is 58 mm.

The closing plug element 15 made of ceramic is shaped according to FIG. 2 and this ensures the length of the conducting way as big as 4.4 mm.

The high-pressure sodium vapor lamp was prepared and started according to the backround art. After ignition the lamp was operated over more thousand hours and no conduction between the electrode 19 and the metal additive 16 was observed.

This can be effectively measured on the basis of the asymmetry of the current transient after connecting the lamp to a supply source. In the current transient of the sodium vapor lamp comprising the closing element according to the invention the duration of the glow discharge phase was about 35% of the duration measured in the constructions realised without the protuberant rib 14. This feature was protected by the proposed gas discharge lamp for very long time. The shortened glow discharge phase and the decrease of the current asymmetry lowered the asymmetric load of the electrodes.

2. High-pressure sodium vapor lamp of 250 W power

The inner diameter of the ceramic discharge vessel is 8 mm, the length is 75 mm.

The closing plug element 15 of the tubular lighting body 1 was prepared according to FIG. 2, ensuring thereby conducting way 17 of length 6.1 mm.

The measurements show that the glow discharge phase lasts here about one forth of the phase characterising the known constructions. After longer operation there was also no change in this situation, i.e. no conducting way could be observed between the electrode and the metal additive containing sodium amalgam.

The main advantage of the high-pressure gas discharge light sources realized according to the invention lies on the fact that the insulation between the electrically conducting electrode and the conducting metallic component of the metal additive, i.e. an appropriate metal alloy or a sodium amalgam is ensured practically during the whole lifetime of the lamp. This has the consequence of increasing this lifetime without necessity of applying a sophisticated construction of the end regions of the tubular lighting bodies.

From the above description, it should be understood that high-pressure gas discharge light sources equivalent to those given above will be within the scope of the claimed invention and such gas discharge light sources will depend on the given circumstances and destination. Further, the plug elements 15 may include one or more openings for receiving parts of the current lead-in 2.

What we claim is:

1. In a high-pressure gas discharge lamp, particularly a high-pressure sodium vapor lamp, comprising a tubular discharge vessel enclosing a discharge space; said discharge vessel being made of a ceramic material and including electrodes and a filling, said filling consisting of at least one ionizable rare gas and a metal additive; ceramic plug elements respectively mounted at each end of said discharge vessel for closing the end regions of said discharge vessel, said ceramic plug elements each having a current lead-in passing therethrough for connecting said electrode with an outer source of supply voltage, said ceramic plug elements each forming front surfaces of said discharge space, at least one of said front surfaces having surface elements of different height levels to form a cold chamber for receiving said metal additive, wherein the shortest electrical conduction path between the surface of the metal additive and the current lead-in as measured along said front surface is at least 4 mm.

2. The high-pressure gas discharge lamp as set forth in claim 1, wherein said one front surface includes an inner and an outer trench divided by a protuberant rib, and said shortest electrical conduction path is measured along a continuous line on the surface of said protuberant rib and on the basic surface of said inner trench.

3. The high-pressure gas discharge lamp as set forth in claim 1, wherein said one front surface is determined by an inner trench, an outer trench adjacent to the wall of said tubular discharge vessel and a protuberant rib, said outer basic surface of the outer trench has a depth exceeding the depth of said inner trench.

4. The high-pressure gas discharge lamp as set forth in claim 1, wherein said cold chamber for receiving said metal additive has a width not exceeding 2 mm.

5. The high-pressure gas discharge lamp as set forth in claim 1, wherein the distance between the tip of said electrode protruding from said plug element and the surface of said metal additive arranged in the cold chamber is at most three times greater than the distance between said electrode and the wall of said tubular discharge vessel.

6. The high-pressure gas discharge lamp as set forth in claim 5, wherein said distance between the tip of said electrode protruding from the surface of said plug element and the surface of said metal additive arranged in the cold chamber is at most 5 mm.

7. In a high-pressure sodium vapor gas discharge lamp, comprising a tubular discharge vessel enclosing a discharge space; said discharge vessel being made of a ceramic material and including electrodes and a filling, said filling consisting of at least one ionizable rare gas and a sodium-containing metal additive; ceramic plug elements respectively mounted at each end of said discharge vessel for closing the end regions of said discharge vessel, said ceramic plug elements each having a current lead-in passing therethrough for connecting said electrode with an outer source of supply voltage; said ceramic plug elements each forming front surfaces of said discharge space, at least one of said front surfaces having surface elements of different height levels, said one front surface including an inner trench and an outer trench divided by a protuberant rib, said outer trench forming a cold chamber for receiving said sodium-containing metal additive, wherein the shortest electrical conduction path between the surface of the metal additive and the current lead-in as measured along the surface of said inner trench adjacent to said electrode, the surface of said outer trench adjacent to the wall of said tubular discharge vessel and the surface of said protuberant rib arranged between said inner trench and said outer trench is at least 4 mm.

* * * * *